US012607104B2

(12) United States Patent
Karakaya et al.

(10) Patent No.: US 12,607,104 B2
(45) Date of Patent: Apr. 21, 2026

(54) QUICK CONNECTOR ASSEMBLIES FOR DOWNHOLE SUCKER ROD PUMPS

(71) Applicant: Saudi Arabian Oil Company, Dhahran (SA)

(72) Inventors: Mustafa Karakaya, Dhahran (SA); Sohrat Baki, Dhahran (SA); Yazed Khudair, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/731,656

(22) Filed: Jun. 3, 2024

(65) Prior Publication Data

US 2025/0369323 A1 Dec. 4, 2025

(51) Int. Cl.
*E21B 43/12* (2006.01)

(52) U.S. Cl.
CPC ..... *E21B 43/127* (2013.01)

(58) Field of Classification Search
CPC ..... E21B 43/127
See application file for complete search history.

(56) References Cited

U.S. PATENT DOCUMENTS

| | | | | |
|---|---|---|---|---|
| 5,518,072 | A | 5/1996 | McTernaghan | |
| 8,997,849 | B2 | 4/2015 | Lea-Wilson et al. | |
| 9,988,858 | B1 | 6/2018 | Hriciák et al. | |
| 11,402,351 | B1 * | 8/2022 | Tolman | G01N 27/9026 |
| 12,031,945 | B1 * | 7/2024 | Uselton | G01N 27/87 |
| 2004/0202521 | A1 | 10/2004 | Bostik | |
| 2008/0066901 | A1 | 3/2008 | Gereluk | |
| 2008/0217023 | A1 * | 9/2008 | Rutledge | F16L 13/103 166/242.6 |
| 2008/0219757 | A1 * | 9/2008 | Rutledge | F04B 47/026 403/268 |
| 2009/0271966 | A1 | 11/2009 | Fotty et al. | |
| 2011/0042942 | A1 * | 2/2011 | Gammons | F16L 37/0841 285/308 |
| 2011/0266005 | A1 * | 11/2011 | Hult | E21B 33/047 166/105 |
| 2012/0292045 | A1 * | 11/2012 | Krawiec | E21B 33/12 166/101 |
| 2013/0032326 | A1 * | 2/2013 | Lea-Wilson | E21B 17/06 403/2 |
| 2018/0361534 | A1 * | 12/2018 | Schneider | B24B 45/006 |
| 2021/0372243 | A1 * | 12/2021 | Arukhe | F03G 7/122 |

* cited by examiner

*Primary Examiner* — Taras P Bemko
(74) *Attorney, Agent, or Firm* — Dinsmore & Shohl LLP

(57) ABSTRACT

A well completion includes a downhole pump, a continuous rod string (COROD) and a first quick-coupling connector assembly. The downhole pump can be disposed at a downhole location within a wellbore. The downhole pump can lift hydrocarbons from the downhole location to a surface of the wellbore. The COROD can couple to the downhole pump. The COROD can axially reciprocate about a longitudinal axis of the wellbore. The first quick-coupling connector assembly includes a first connector coupled to an end of the COROD. The first quick-coupling connector assembly includes a second connector coupled to an end of the downhole pump. The first connector and the second connector can be coupled by an axial force toward each other and be de-coupled by an opposing axial force away from each other.

17 Claims, 5 Drawing Sheets

QUICK CONNECTOR ASSEMBLIES FOR DOWNHOLE SUCKER ROD PUMPS

TECHNICAL FIELD

This disclosure relates to producing hydrocarbons through wellbores, and particularly to using downhole pumps, e.g., sucker rod pumps, to produce hydrocarbons.

BACKGROUND

Hydrocarbons entrapped in subsurface reservoirs can be produced (i.e., raised to the surface) through wellbores. A wellbore is formed from a surface of the Earth to the subsurface reservoir through a subterranean zone (e.g., a formation, a portion of a formation or multiple formations). Well completions can be installed within the wellbore to facilitate the hydrocarbon production. In primary techniques of hydrocarbon recovery, the hydrocarbons (e.g., oil, natural gas, some cases water, mixtures of them) flow from the subsurface reservoirs to the surface under a formation pressure exerted by the subterranean zone on the hydrocarbons. Over time, the formation pressure decreases and secondary (or even tertiary) techniques of hydrocarbon recovery are deployed.

One such secondary technique is the use of downhole pumps. To deploy such a technique, a hydrocarbon pump is installed at a downhole location within the wellbore. When operated, the hydrocarbon pump draws hydrocarbons from downhole of the pump and lifts the drawn hydrocarbons towards the surface. A sucker rod pump is an example of a downhole pump that can be used in such secondary hydrocarbon recovery techniques.

SUMMARY

This disclosures describes technologies relating to quick connector assemblies for downhole sucker rod pumps.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1B:
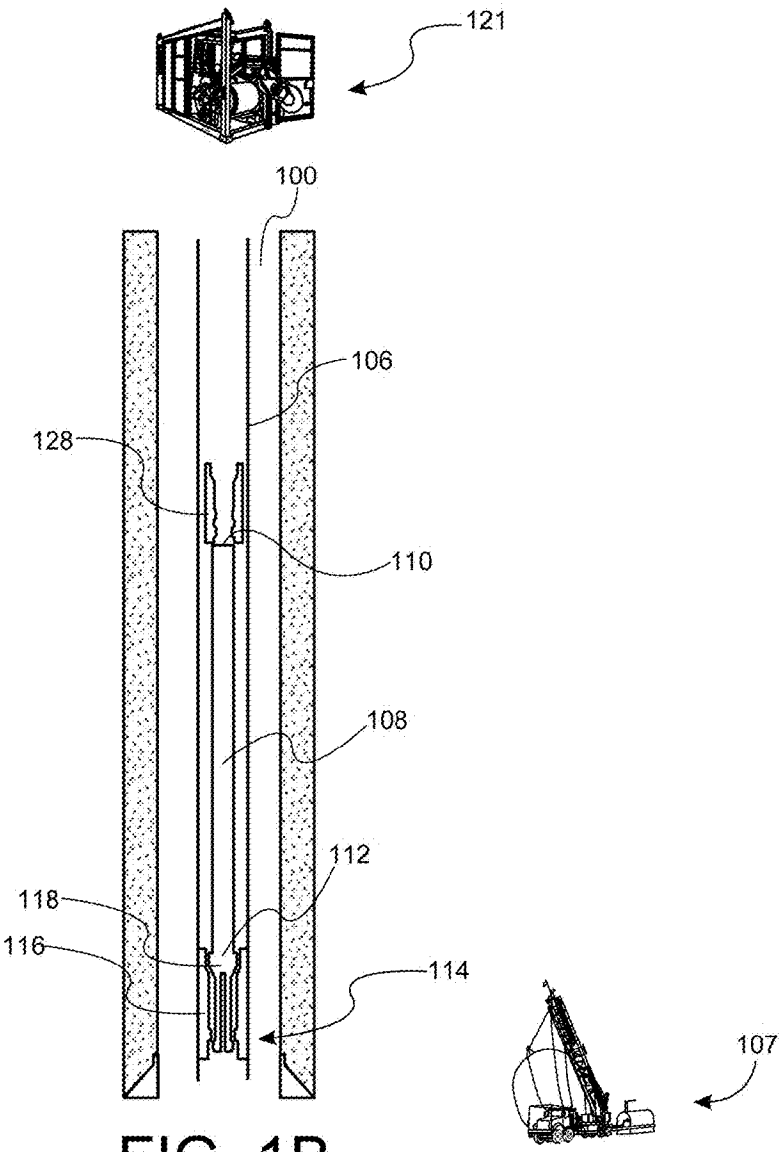
FIGS. 1A-1D are schematic diagrams showing an installation of an example of a sucker rod (combination of single rods or COROD system) and an example of a sucker rod pump at a downhole location within a wellbore using quick-coupling connector assemblies.

Sucker rod systems (e.g., a sucker rod pump, a sucker rod, a pump seat and a mechanical reciprocating assembly) are used in oil production. Sucker rod systems can also be used for water supply systems, gas wells and for unloading the fluid in the well to increase gas production. The pump seat is installed at a downhole end of a tubing or liner that is installed within a wellbore through which the hydrocarbons are to be produced. The sucker rod pump sits within the pump seat to form a fluid-tight connection. The mechanical reciprocating assembly is installed at a surface of the wellbore and can convert a rotary motion (e.g., of a motor) into a reciprocating motion. The reciprocating motion moves the sucker rod in an uphole direction. The sucker rod then drops downhole under its own weight.

Sucker rod strings can be made from joint-by-joint sucker rods or continuous rod strings (CORODs). Single sucker rods can be about 30 feet (or about 10 meters) long, while CORODs can be any length (e.g., between 4,000 and over 12,000 feet, which is between 1200 and over 3500 meters).

This disclosure describes a COROD coupled to a downhole pump with a quick-coupling connector assembly. This disclosure also describes a quick-coupling connector assembly that couples the downhole pump to a pump seat installed at a downhole end of a tubing within which the downhole pump is installed. In the context of this disclosure, "quick-coupling connector" refers to mechanical coupling elements that can be deployed to quickly couple and de-couple two components. Certain mechanical coupling elements include threaded connections and require rotation of components for coupling. In contrast, the quick-coupling connector described here is configured to couple by an axial movement of components towards each other, and to de-couple by an axial movement of components away from each other. Therefore, instead of relying on turning motion to couple threads, the quick-coupling connector described here can be coupled by a stinging action and de-coupled simply by pulling apart.

Implementing the techniques described here can provide the following advantages. The quick-coupling connector permits multiple latch-unlatch setups. Consequently, the same connector can be used multiple times to connect and disconnect the sucker rod pump to the pump seat or the COROD to the sucker rod pump (or both). The implementations described here serve as viable alternatives to one-time safety shear pin systems that are used for coupling the components described here. Quick-coupling connector will work as a safety break option without using one-time shear pins. It also allow to safety shear system to connect to downhole pump at the surface (almost all standard safety shear pins can be install at surface). Implementing the techniques described here can allow running in downhole pumps with slickline or wireline instead of needing to run the COROD system in hole with the downhole pump. Such running of downhole pumps can be performed using wellhead lubricators. As described later, the techniques described here can be implemented to convert a flowing well condition into a static well condition or to convert an underbalance condition to an overbalance condition.

Figure 1A:
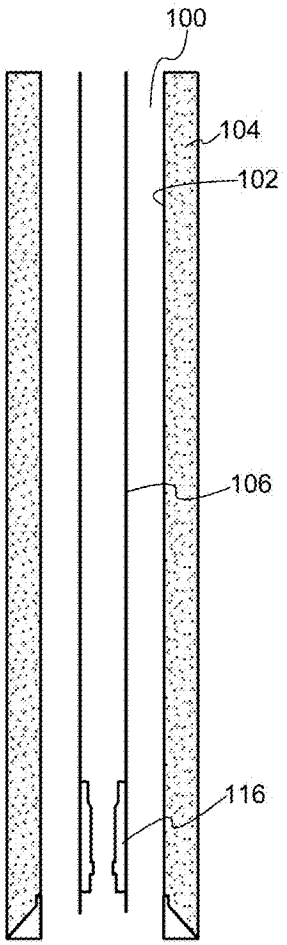

FIGS. 1A-1D are schematic diagrams showing an installation of an example of a sucker rod and an example of a sucker rod pump at a downhole location within a wellbore using quick-coupling connector assemblies. FIG. 1A shows an example of a wellbore 100 formed in a subterranean zone. The wellbore 100 extends from a surface of the Earth to a subsurface reservoir in which hydrocarbons are entrapped. In some implementations, a casing (or tubing) 102 can be installed within the wellbore 100. The annular spacing between the casing 102 and the wellbore 100 can be filled with cement 104. A production tubing 106 is installed within the wellbore 100, specifically within the casing 102. The hydrocarbons flow from the subsurface reservoir to the surface through the production tubing 106. In some implementations, a well completion including a portion of a sucker rod pump system is installed within the production tubing 106. Piece 116 almost always run with tubing string. Some cases there are setting tool system (called pump anchor) that can run with bottom of the rod string or COROD systems.

FIG. 1B shows an example of a downhole pump 108 installed within the production tubing 106 at a downhole location, e.g., using a wireline assembly 121. The downhole pump 108 is a sucker rod pump that can lift hydrocarbons from downhole of the downhole pump 108 to the surface of the wellbore 100. The downhole pump 108 includes a first end 110 (e.g., an uphole end) and a second end 112 (e.g., a downhole end). When the downhole pump 108 is installed within the wellbore 100, the first end 110 is uphole of the second end 112. Most of the case sucker rod pump run in the hole with sucker rod string or COROD. Some cases sucker rod pump run in hole with slickline or wireline. Some cases sucker rod pump can run in hole together with tubing string also.

The downhole pump 108 is coupled to the production tubing 106 by a pump quick-coupling connector assembly 114. The pump quick-coupling connector assembly 114 includes two parts—a connector 116 that is installed at the end of the production tubing 106 (FIGS. 1A, 1B), and a connector 118 that is coupled to the second end 112 of the downhole pump 108. The connector 116 and the connector 118 can be coupled to each other by an axial force toward each other and de-coupled by an opposing axial force away from each other. For example, the connector 116 is coupled to the downhole end of the production tubing 106. The connector 116 can be coupled before the production tubing 106 is installed within the wellbore 100 (e.g., when making up the production tubing 106). Alternatively, the connector 116 can be coupled after the production tubing 106 is installed within the wellbore 100, e.g., using a setting tool system called a pump anchor. The connector 118 is coupled to the second end 112 of the downhole pump 108. When the pump anchor with the sucker rod string is reciprocated up and down, a slip system on the pump anchor sets into the inside of the production tubing 106. The downhole pump 108 is then run into the wellbore 100, e.g., using a wireline, slickline, coiled tubing or other methods. The weight of the downhole pump 108 is sufficient to sting the connector 118 into the connector 116. The weight of the downhole pump 108 causes the connector 118 to slightly collapse inward and pass through an opening in the connector 116.

Figure 2C:
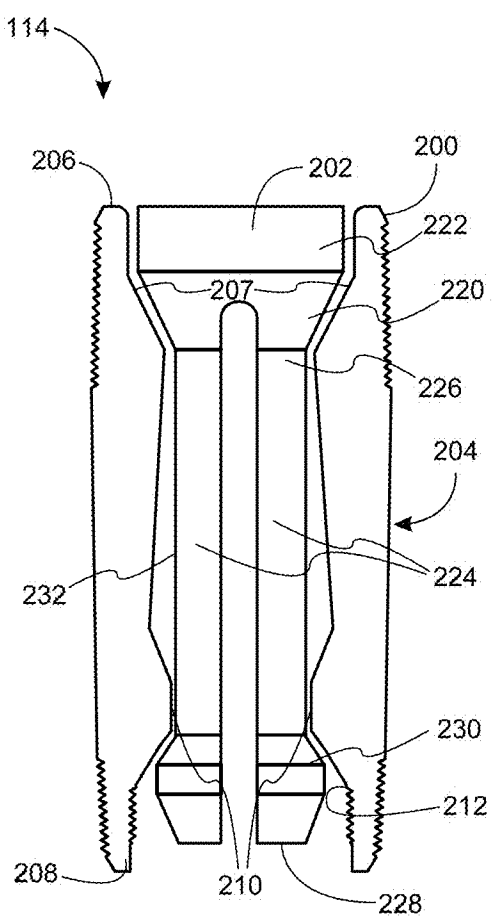
FIGS. 2A-2C are schematic diagrams showing an example of a single grip quick-coupling connector that couples a sucker rod pump to a production tubing installed within the wellbore.
Figure 2B:
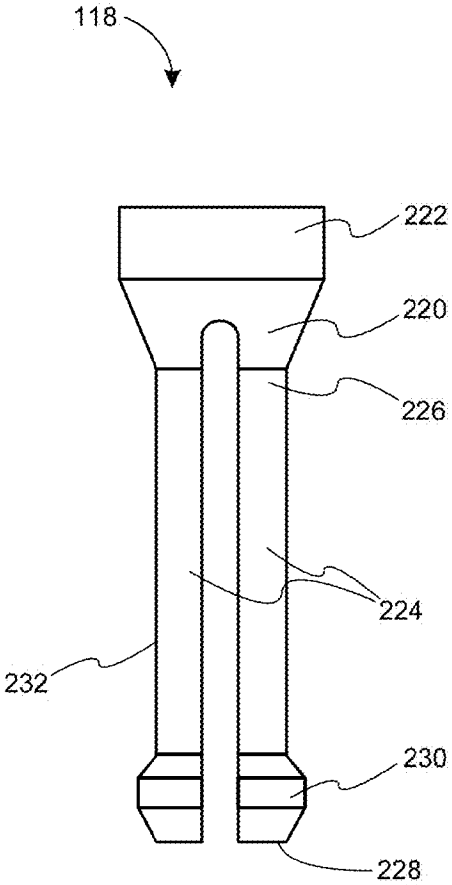
Figure 2A:
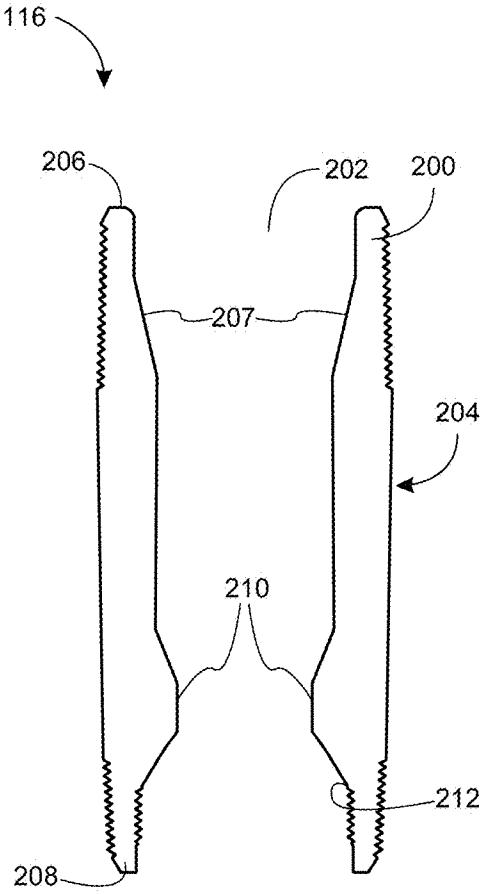

FIGS. 2A-2C are schematic diagrams showing an example of the quick-coupling connector 114. FIG. 2A schematically shows the connector 116. The connector 116 includes a body 200 that defines an annular portion 202. An outer diameter of the body 200 is sized so that the body 200 can be installed at a downhole end of the production tubing 106 (FIG. 1A). Once installed, the body 200 remains coupled to the downhole end of the production tubing 106 (FIG. 1A). The body 200 includes an axial portion 204 that has a length of the body 200, which is at least equal to a length of a body of the connector 118 described later. The axial portion 204 can have a length between 4 inches (about 10 centimeters) and 6 inches (about 15 centimeters). The length of the axial portion 204 should be sufficient to permit minimal flexing of the axial portion 204 (e.g., in a radially outward direction) needed when the connector 118 is stung into the connector 116. Also, the length of the axial portion 204 should be sufficient to permit minimal flexing of the axial portion 204 needed when the connector 118 is stung out of the connector 116. The length of the axial portion 204 should also be sufficient to retain the downhole pump 108 in its downhole location during normal operation of the downhole pump 108 including the reciprocating operation. The length of the axial portion 204 should further be sufficient to ensure a seal between the downhole end of the downhole pump 108 and the downhole end of the production tubing 106 at which the downhole pump 108 and the production tubing 106 are coupled.

The body 200 includes a first end 206 and a second end 208. When installed in the production tubing 106 (FIG. 1A), the first end 206 is an uphole end and the second end 208 is a downhole end. The annular portion 202 extends from the first end 206 to the second end 208. The inner diameter of the annular portion 202 near the first end 206 is greater than an inner diameter of the annular portion 202 near the second end 208. The inner surface of the body 200 tapers from the portion that has the greater inner diameter to the portion that has the comparatively smaller inner diameter (see tapered portion 207). For example, the tapered portion 207 has a conical construction to hold the loads and establish a seal. During manufacture, the tapered portion 207 matches with a complementary shape of the connector 118 to allow the seal. Such a construction facilitates receiving the connector 118 within the annular portion 202.

Figure 1D:
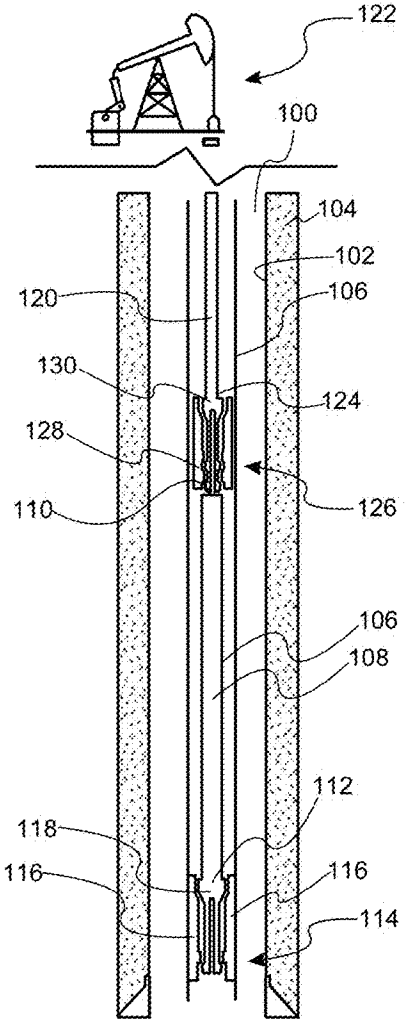
Figure 1C:
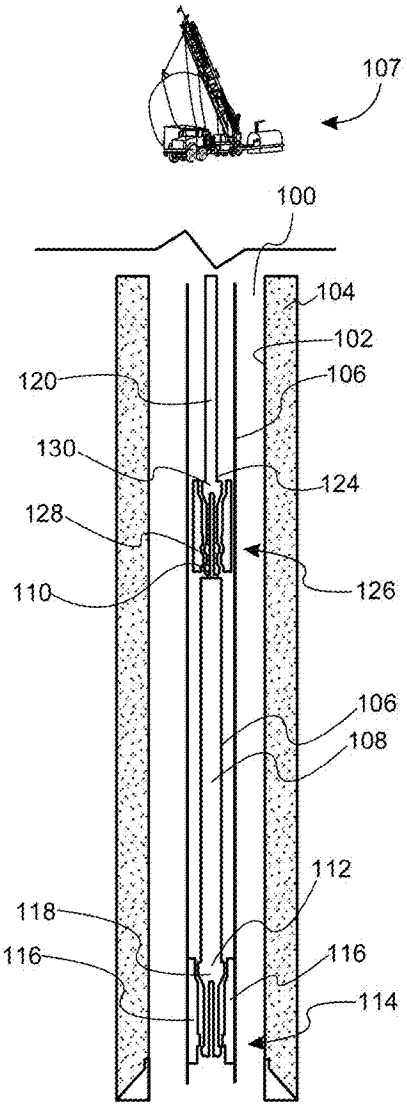

In some implementations, the axial portion 204 defines a shoulder 210 on an inner surface 212 of the axial portion 204 of the body 200. The shoulder 210 protrudes radially inward (i.e., towards a center of the production tubing 106 (FIG. 1A)). As described later, the connector 118 includes a shoulder that engages with the shoulder 210 of the body 200 to couple the connector 116 and the connector 118. The edges of the shoulder 210 are angled to allow the connector 116 to receive the connector 118 by stinging in of the downhole pump 108, maintains the connection (including carrying the loads and maintaining the seal) between the connector 116 and the connector 118, and separates the connector 116 and the connector 118 by stinging out of the downhole pump 108. In particular, the angles of the edges of the shoulder 210 are selected such that the force to sting the connector 118 into the connector 116 is less than the force to sting the connector 118 out of the connector 116. The angles are also selected such that a force to sting the connector 118 out of the connector 116 is less than a force that could break the COROD 120 (FIG. 1C).

For example, an angle between the shoulder 210 and the longitudinal axis of the body 200 at the uphole end of the shoulder 210 can be about 30 degrees. An angle between the shoulder 210 and the longitudinal axis of the body 200 at the downhole end of the shoulder 210 can be about 60 degrees. Such a construction provides a smaller slope when the connector 118 stings into the connector 116, but provides a comparatively larger slope when the connector 118 stings out of the connector 116. The angles between the ends of the shoulder 210 and the longitudinal axis of the body 200 can vary from the example mentioned here as long as the construction provides the slope variation that facilitates stinging in the connector 118 into the connector 116, while making stinging out comparatively more difficult.

FIG. 2B schematically shows the connector 118. The connector 118 includes a body 220 that defines an annular portion 222. An outer diameter of the body 220 is sized so that the body 220 can be received within the inner diameter 202 of the body 200 of the connector 116 (FIG. 2A). The body 220 includes multiple fingers 224, each having a first end 226 and a second end 228. The length of the fingers 224 depends on the length of the axial portion 204 of the connector 116 (FIG. 2A). The length of the fingers 224 should be long enough to pass through the annular portion 202 (FIG. 2A) and to extend downhole of the shoulder 210 to form the mechanical connection between the connector 118 and the connector 116 (FIG. 2A). The length of the fingers 224 should be sufficient to permit minimal flexing of the fingers 224 (e.g., in a radially inward direction) needed when the connector 118 is stung into the connector 116. Also, the length of the fingers 224 should be sufficient to permit minimal flexing of the fingers 224 needed when the connector 118 is stung out of the connector 116. The length of the fingers 224 should also be sufficient to retain the downhole pump 108 in its downhole location during normal operation of the downhole pump 108 including the reciprocating operation. The length of the fingers 224 should further be sufficient to ensure a seal between the downhole end of the downhole pump 108 and the downhole end of the production tubing 106 at which the downhole pump 108 and the production tubing 106 are coupled The outer shape of the annular portion 222 matches (or complements) an inner shape of the tapered portion 207 of the body 200 of the connector 116 (FIG. 2A). Such a construction facilitates inserting the connector 118 into the connector 116 when the downhole pump 108 (FIG. 1B) is run into the wellbore 100 (FIG. 1B). Such a construction also ensures that the matching outer shape of the annular portion 222 and inner shape of the tapered portion 207 creates a mechanical seal at the uphole end of the connector 116 and the connector 118. The first end 226 of each finger 224 is attached to the annular portion 222 and extends away from (i.e., in a downhole direction) from the annular portion 222.

In some implementations, each finger 224 defines a shoulder 230 on an outer surface 232 of the each finger 224. The shoulder 230 protrudes radially outward (i.e., away from a center of the production tubing 106 (FIG. 1A)). The amount by which the shoulder 230 extends away from the outer surface 232 of the finger 224 is at least equal to or greater than an amount by which the shoulder 210 extends inward towards a center of the production tubing 106 (FIG. 1A). In addition, the axial position of the shoulder 230 on the outer surface 232 of the finger 224 is uphole of the axial position of the shoulder 210 on the inner surface 212. The edges of the shoulder 230 are angled to allow the connector 116 to receive the connector 118 by stinging in of the downhole pump 108, maintains the connection (including carrying the loads and maintaining the seal) between the connector 116 and the connector 118, and separates the connector 116 and the connector 118 by stinging out of the downhole pump 108. In particular, the angles of the edges of the shoulder 230 are selected such that the force to sting the connector 118 into the connector 116 is less than the force to sting the connector 118 out of the connector 116. The angles are also selected such that a force to sting the connector 118 out of the connector 116 is less than a force that could break the COROD 120 (FIG. 1C).

For example, an angle between the shoulder 230 and the longitudinal axis of the body 220 at the uphole end of the shoulder 230 can be about 60 degrees (i.e., complementary to the 30 degree angle between the shoulder 210 and the longitudinal axis of the body 200 at the uphole end of the shoulder 210). An angle between the shoulder 230 and the longitudinal axis of the body 220 at the downhole end of the shoulder 230 can be about 30 degrees (i.e., complementary to the 60 degree angle between the shoulder 210 and the longitudinal axis of the body 200 at the downhole end of the shoulder 210). Such a construction provides a smaller slope when the connector 118 stings into the connector 116, but provides a comparatively larger slope when the connector 118 stings out of the connector 116. The angles between the ends of the shoulder 230 and the longitudinal axis of the body 220 can vary from the example mentioned here as long as the construction provides the slope variation that facilitates stinging in the connector 118 into the connector 116, while making stinging out comparatively more difficult.

FIG. 2C shows the connector 118 stung into the connector 116 to form the pump quick-coupling connector assembly 114. Under such construction, when the connector 118 is stung into the connector 116, the second end 228 of the fingers 224 contact the shoulder 210 and flex inwardly (i.e., towards a center of the production tubing 106 (FIG. 1A)). The shoulder 230 then passes through the annular portion 202 and downhole of the shoulder 210. After the shoulder 230 passes the shoulder 210, the fingers 224 flex outwardly (i.e., away from the center of the production tubing 106 (FIG. 1A)). The downhole portion of the shoulder 210 then engages the uphole portion of the shoulder 230 to couple the connector 116 to the connector 118. Because the outer diameter of the annular portion 222 is greater than an inner diameter of a bottom portion of the body 200, further downhole movement of the connector 118 within the connector 116 is restricted. In this manner, the connector 116 is quickly coupled to the connector 118 by an axially downward movement of the connector 116.

Returning to FIG. 1C, the figure shows an example of a COROD 120 that has been run into the wellbore 100, e.g., using a COROD unit 107. The COROD 120 is coupled to the first end 110 (i.e., the uphole end) of the downhole pump 108. FIG. 1D shows an example of the COROD 120 including a first end (not shown) that is coupled to a mechanical reciprocating assembly 122 that is installed at the surface of the wellbore 100. The COROD 120 includes a second end 124 (e.g., a downhole end) that is coupled to an uphole end 110 (FIG. 1B) of the downhole pump 108.

The COROD 120 is coupled to the downhole pump 108 by a COROD quick-coupling connector assembly 126. The COROD quick-coupling connector assembly 126 includes two parts—a connector 128 that is coupled to the first end 110 of the downhole pump 108 (FIGS. 1B, 1C), and a connector 130 that is coupled to the second end 124 of the COROD 120. The connector 128 and the connector 130 can be coupled to each other by an axial force toward each other and de-coupled by an opposing axial force away from each other. For example, the connector 128 is coupled, e.g., mechanically, to the first end 110 of the downhole pump 108. The connector 128 can be coupled before the downhole pump 108 is run into the wellbore 100 (e.g., to sting the downhole pump 108 into the production tubing 106) or after the downhole pump 108 has been run into the wellbore 100. The connector 130 is coupled to the second end 124 of the COROD 120, e.g., by a threaded connection between the connector 130 and the second end 124 of the COROD 120. The COROD 120 is then run into the wellbore 100. In particular, the COROD 120 is run into the wellbore 100. The weight of the rod string is sufficient to sting the connector 130 into the connector 128.

In some implementations, the COROD 120 and the downhole pump 108 are run into the wellbore 100 together as one assembly. The connector 118, which is a part of this assembly, is stung into the connector 116. In some implementations, the downhole pump 108 is run into the wellbore using a slickline, wireline or coil tubing without the COROD 120.

The connector 118 is stung into the connector 116. Then, the COROD 120 is run into the wellbore. The connector 130, which is a part of the COROD 120 string, is stung into the connector 128.

Figure 3C:
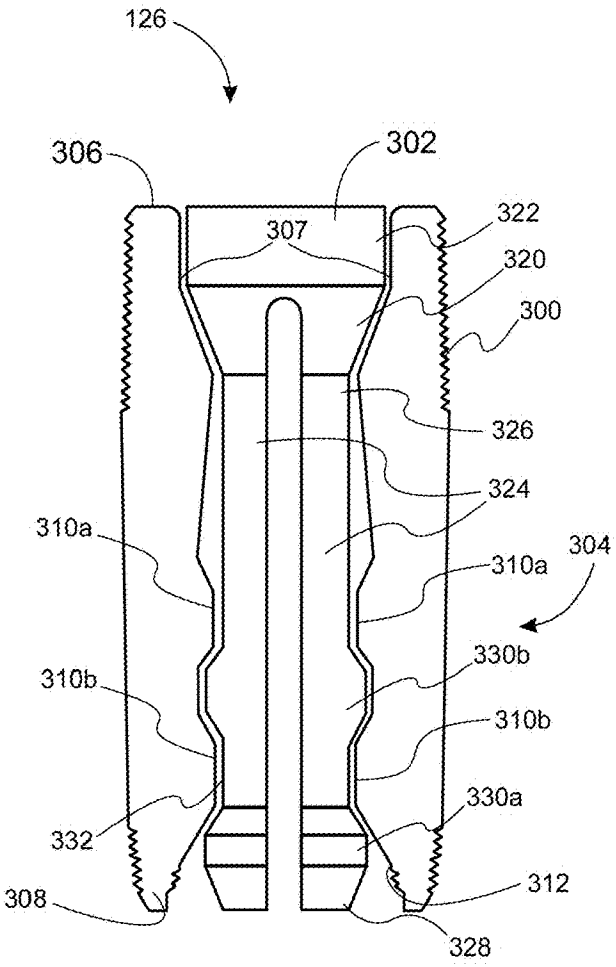
FIGS. 3A-3C are schematic diagrams showing an example of a double grip quick-coupling connector that couples a sucker rod to the sucker rod pump.
Figure 3B:
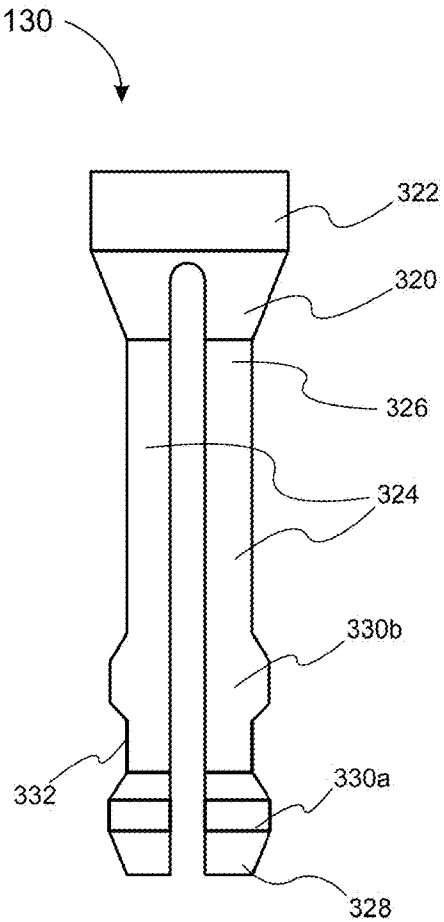
Figure 3A:
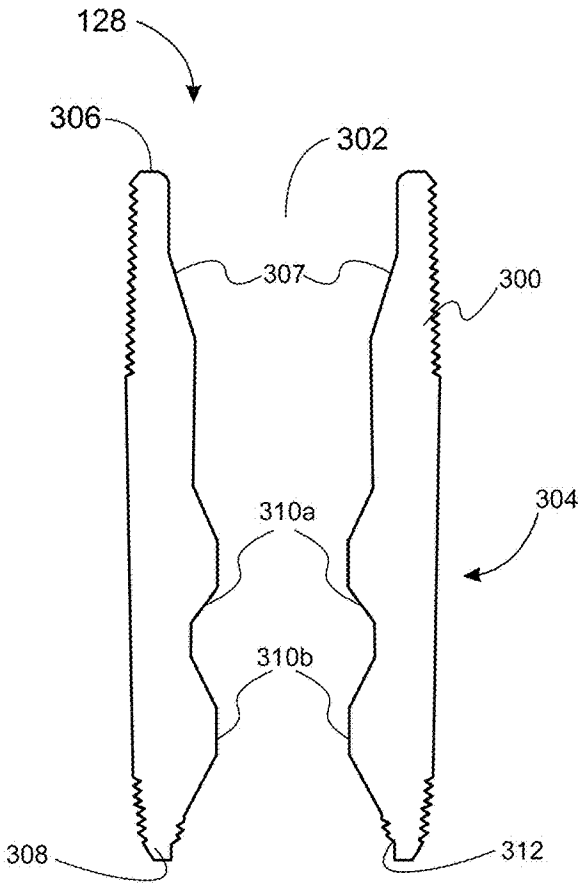

FIGS. 3A-3C are schematic diagrams showing an example of the quick-coupling connector 126. FIG. 3A schematically shows the connector 128. The connector 128 includes a body 300 that defines an annular portion 302. An outer diameter of the body 300 is sized so that the body 300 can be installed at the first end 110 of the downhole pump 108 (FIG. 1B). For example, an inner diameter of the annular portion 302 can be large enough to completely surround the outer diameter at the first end 110 of the downhole pump 108 (FIG. 1B). Once installed, the body 300 remains coupled to the first end 110 of the downhole pump 108 (FIG. 1B). The body 300 includes an axial portion 304 that has a length of the body 300 is at least equal to a length of a body of the connector 130 described later. The axial portion 304 of the body 300 has characteristics (e.g., length, flexibility, etc.) that are substantially similar or identical to characteristics of the axial portion 204 of the body 200 (FIGS. 2A-2C).

The body 300 includes a first end 306 and a second end 308. When coupled to the first end 110 of the downhole pump 108 (FIG. 1B), the first end 306 is an uphole end and the second end 308 is a downhole end. The annular portion 302 extends from the first end 306 to the second end 308. The inner diameter of the annular portion 302 near the first end 306 is greater than an inner diameter of the annular portion 302 near the second end 308. The inner surface of the body 300 tapers from the portion that has the greater inner diameter to the portion that has the comparatively smaller inner diameter (see tapered portion 307). For example, the tapered portion 307 has a conical construction to hold the loads. During manufacture, the tapered portion 307 matches with a complementary shape of the connector 130 to allow the sting in-sting out or locking. Such a construction facilitates receiving the connector 130 within the annular portion 302.

In some implementations, the axial portion 304 defines multiple shoulders (e.g., a first shoulder 310*a*, a second shoulder 310*b*) on an inner surface 312 of the axial portion 304 of the body 300. The number of shoulders on the connector 128 can be more than (e.g., at least one more than) the number of shoulders 210 on the connector 116 (FIG. 2A). Each shoulder protrudes (e.g., a first shoulder 310*a*, a second shoulder 310*b*) radially inward (i.e., towards a center of the production tubing 106 (FIG. 1A)). As described later, the connector 130 includes multiple shoulders that respectively engage with the multiple shoulders of the body 300 to couple the connector 128 and the connector 130. The edges of each of the shoulders 310*a*, 310*b* are angled in a manner that is substantially similar or identical to the edges of the shoulder 210 (FIG. 2A).

FIG. 3B schematically shows the connector 130. The connector 130 includes a body 320 that defines an annular portion 322. An outer diameter of the body 320 is sized so that the body 320 can be received within the inner diameter 302 of the body 300 of the connector 128 (FIG. 3A). The body 320 includes multiple fingers 324, each having a first end 326 and a second end 328. The shape and construction of the annular portion 322 and the multiple fingers 324 is substantially similar or identical to that of the annular portion 222 (FIG. 2B) and the multiple fingers 224 (FIG. 2B), respectively.

The outer diameter of the annular portion 322 is equal to or less than an inner diameter of the near the uphole end 306 of the body 300 of the connector 128 (FIG. 3A). Such a construction facilitates inserting the connector 130 into the connector 128 when the COROD 120 (FIG. 1C) is run into the wellbore 100 (FIG. 1C). The first end 326 of each finger 324 is attached to the annular portion 322 and extends away from (i.e., in a downhole direction) from the annular portion 322.

In some implementations, each finger 324 defines multiple shoulders (e.g., a first shoulder 330*a*, a second shoulder 330B on an outer surface 332 of the each finger 324. The number of shoulders on the connector 130 can be more than (e.g., at least one more than) the number of shoulders 230 on the connector 118 (FIG. 2B). Each shoulder protrudes radially outward (i.e., away from a center of the production tubing 106 (FIG. 1A)). The amount by which each of the shoulders 330*a*, 33*b* extends away from the outer surface 332 of the finger 324 is at least equal to or greater than an amount by which each of the shoulders 310*a*, 310*b* extends inward towards a center of the production tubing 106 (FIG. 1A). In addition, the axial position of each of the shoulders 330*a*, 330*b* on the outer surface 332 of the finger 324 is uphole of the axial position of each of the shoulders 310*a*, 310*b* on the inner surface 312. The edges of each of the shoulders 330*a*, 330*b* are angled in a manner that is substantially similar or identical to the edges of the shoulder 230 (FIG. 2B).

FIG. 3C shows the connector 130 stung into the connector 128 to form the COROD quick-coupling connector assembly 126. Under such construction, when the connector 130 is stung into the connector 128, the second end 328 of the fingers 324 contact the shoulder 310*a* and flex inwardly (i.e., towards a center of the production tubing 106 (FIG. 1A)). The shoulder 330*a* then passes through the annular portion 302 and downhole of the shoulder 310*a* to pass the shoulder 310*b*. Similarly, the shoulder 330*b* passes the shoulder 310*a*. After the shoulders 330*a*, 330*b* pass the shoulders 310*a*, 310*b*, the fingers 324 flex outwardly (i.e., away from the center of the production tubing 106 (FIG. 1A)). The downhole portion of one of the shoulders 310*a*, 310*b* then engages the uphole portion of one of the shoulders 330*a*, 330*b* to couple the connector 128 to the connector 130. Because the outer diameter of the annular portion 322 is greater than an inner diameter of a bottom portion of the body 300, further downhole movement of the connector 130 within the connector 128 is restricted. In this manner, the connector 128 is quickly coupled to the connector 130 by an axially downward movement of the connector 128.

As described earlier, an axial force in an uphole direction, e.g., a tension on, the COROD 120 can cause a decoupling of the COROD quick-coupling connector assembly 126. Such an axial force can cause the connector 130 to be pulled away from and out of the connector 128. Similarly, an axial force in the uphole direction, e.g., a tension on, the downhole pump 108 can cause a decoupling of the pump quick-coupling connector assembly 114. Such an axial force can cause the connector 118 to be pulled away from and out of the connector 116.

The axial force to de-couple the COROD quick-coupling connector assembly 126 is greater than the axial force to de-couple the pump quick-coupling connector assembly 114. This characteristic is due to the additional number of shoulders (310*a*, 310*b*, 330*a*, 330*b*) on the connectors 128 and 130 (FIG. 3C) compared to the fewer number of shoulders (210, 230) on the connectors 114 and 116 (FIG. 2C). That is, the force to pull the shoulder 230 of the connector 118 past the shoulder 210 of the connector 116 (FIG. 2C) is less compared to the force to pull the shoulders

330*a*, 330*b* of the connector 130 past the shoulders 310*a*, 310*b* of the connector 128 (FIG. 2C). The schematic shows that the connectors of the pump quick-coupling connector assembly 114 each has one shoulder and the connectors of the COROD quick-coupling connector assembly 126 each has two shoulders. However, each connector of each assembly can have additional shoulders as long as the connectors of the COROD quick-coupling connector assembly 126 has at least one more shoulder than the connectors of the pump quick-coupling connector assembly 114.

The connectors can be made using materials that can withstand downhole conditions (e.g., high temperature and pressure, corrosive nature of hydrocarbons, etc.) and that can also facilitate the structural features described here, e.g., carbon steel, composite materials, some special elastomers, alloys that include copper or bronze or both. In some implementations, the materials can be selected and the connectors can be designed and constructed such that the axial force to de-couple the COROD quick-coupling connector assembly 126 is less than a breaking force that causes the COROD 120 to break under rotation. Therefore, a first axial force in an uphole direction can be sufficient to separate the connectors of the pump quick-coupling connector assembly 114 but not the connectors of the COROD quick-coupling connector assembly 126. A second axial force greater than the first axial force can be sufficient to separate the connectors of the COROD quick-coupling assembly 126 without breaking the COROD 120 itself. In addition, the connectors are sized and constructed such that the pump quick-coupling connector assembly 114 forms a fluidic connection that draws hydrocarbons downhole of the downhole pump 108 through the pump quick-coupling connector assembly 114 and into a pump inlet. Similarly, the COROD quick-coupling connector assembly 114 forms a mechanical connection that flows the hydrocarbons from the pump outlet into an annular region between the COROD 120 and the production tubing 106.

FIGS. 4A-4D are schematic diagrams showing an installation of an example of a sucker rod pump at a downhole location within a wellbore using a quick-coupling connector assembly. FIGS. 4A-4D schematically show a downhole pump (e.g., a sucker rod pump) that implements a pump quick-coupling connector assembly 114 but does not implement a COROD quick-coupling connector assembly 126.

Figure 4D:
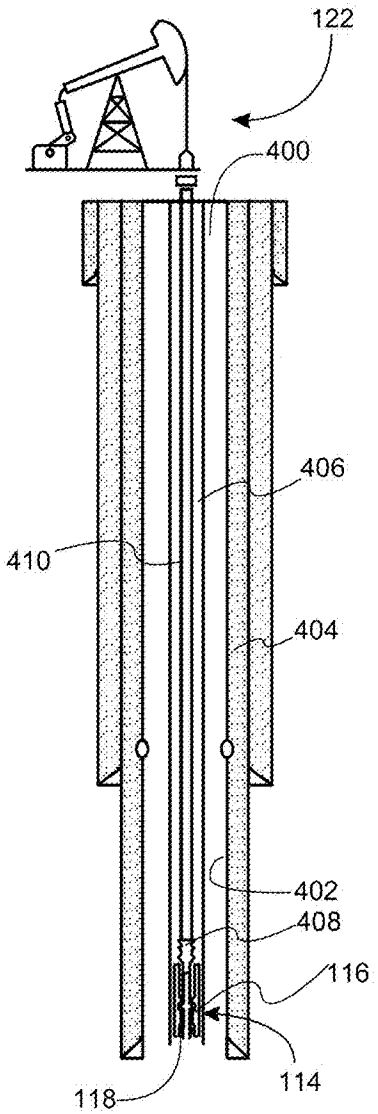
FIGS. 4A-4D are schematic diagrams showing an installation of an example of a sucker rod pump at a downhole location within a wellbore using a quick-coupling connector assembly.
Figure 4C:
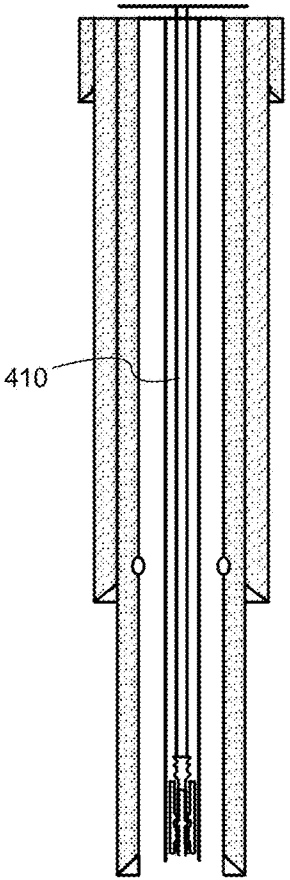
Figure 4B:
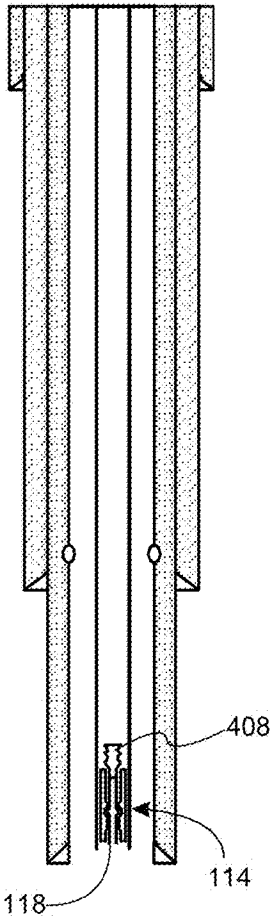
Figure 4A:
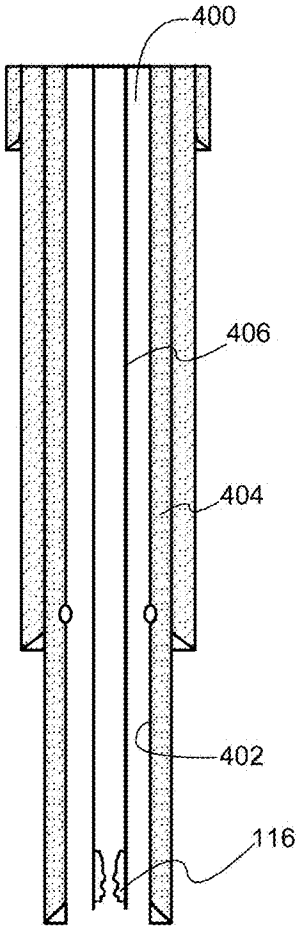

FIG. 4A shows an example of a wellbore 400 formed in a subterranean zone. The wellbore 400 extends from a surface of the Earth to a subsurface reservoir in which hydrocarbons are entrapped. In some implementations, a casing 402 (or multiple telescoping casings) can be installed within the wellbore 400. The annular spacing between the casing 402 and the wellbore 400 (or between two casings) can be filled with cement 404. A production tubing 406 is installed within the wellbore 400, specifically within the casing 402. The hydrocarbons flow from the subsurface reservoir to the surface through the production tubing 406. In some implementations, a well completion including a portion of a sucker rod pump system is installed within the production tubing 406. As described below, a connector (substantially similar or identical to the connector 116) can be installed at the downhole end of the production tubing 406 before the production tubing 406 is run in hole.

FIG. 4B shows an example of a downhole pump 408 installed within the production tubing 406 at a downhole location. The downhole pump 408 is a sucker rod pump that can lift hydrocarbons from downhole of the downhole pump 408 to the surface of the wellbore 400. The downhole pump 408 is coupled to the production tubing 406 by a quick-coupling connector assembly that is substantially identical to the pump quick-coupling connector assembly 114 (FIGS. 2A-2C) or to the COROD quick-coupling connector assembly 126 (FIGS. 3A-3C). For example, the connector of the quick-coupling connector assembly, which is substantially similar or identical to the connector 116 of the pump quick-coupling connector assembly 114, can be installed in the production tubing 406 using techniques similar to those described above (FIG. 1A). A connector, which is substantially similar or identical to the connector 118, can be coupled to the downhole end of the downhole pump 408 using techniques similar to those described above (FIG. 1B). The axial force due to the downhole motion of the downhole pump 408 can sting the connector 118 within the connector 116 to form the fluidic connection described above.

FIG. 4C shows a COROD 410 coupled to the uphole end of the downhole pump 408 and run into the wellbore using a COROD unit 107. In some implementations, the downhole end of the COROD 410 can be coupled without a quick-coupling connector assembly, e.g., by a threaded connection. FIG. 4D shows the uphole end of the COROD 410 coupled to a mechanical reciprocating assembly 122 that is installed at the surface of the wellbore 100. In some implementations, the production tubing 406 can be filled with a high density or heavy fluid. In such implementations, the downhole pump 408 establishes a barrier for oil and gas flow.

In some implementations, the downhole pump can be coupled to a pump seat at a downhole end of the production tubing without the use of a quick-coupling connector assembly. In such implementations, the COROD can be coupled to the uphole end of the downhole pump using a quick-coupling connector such as the COROD quick-coupling connector assembly 126 (FIGS. 3A-3C).

EXAMPLES

Certain aspects of the subject matter described here can be implemented as a well completion that includes a downhole pump, a COROD and a first quick-coupling connector assembly. The downhole pump can be disposed at a downhole location within a wellbore. The downhole pump can lift hydrocarbons from the downhole location to a surface of the wellbore. The COROD can couple to the downhole pump. The COROD can axially reciprocate about a longitudinal axis of the wellbore. The first quick-coupling connector assembly includes a first connector coupled to an end of the COROD. The first quick-coupling connector assembly includes a second connector coupled to an end of the downhole pump. The first connector and the second connector can be coupled by an axial force toward each other and be de-coupled by an opposing axial force away from each other.

An aspect combinable with any other aspect includes the following features. The well completion includes a tubing that can be disposed within the wellbore. The downhole pump can be installed within and at an end of the tubing. The well completion includes a second quick-coupling connector assembly. The second quick-coupling connector assembly includes a third connector and a fourth connector. The third connector is installed at the end of the tubing at which the downhole pump is to be installed. The fourth connector is coupled to an end of the downhole pump. The third connector and the fourth connector can be coupled by an axial force toward each other and be de-coupled by an opposing axial force away from each other.

An aspect combinable with any other aspect includes the following features. The axial force to de-couple the first connector from the second connector is greater than the axial force to de-couple the third connector from the fourth connector.

An aspect combinable with any other aspect includes the following features. The axial force to de-couple the first connector from the second connector is less than a force at which the COROD breaks.

An aspect combinable with any other aspect includes the following features. The first connector includes an annular portion at a first end of the first connector and multiple fingers. A first end of each finger is attached to the annular portion. Each finger extends away from the first end and terminates at a second end.

An aspect combinable with any other aspect includes the following features. The multiple fingers can flex towards each other at respective second ends of the multiple fingers.

An aspect combinable with any other aspect includes the following features. Each finger defines an outer surface. Each outer surface of each finger defines two shoulders that are axially spaced apart and that extend radially away from the outer surface.

An aspect combinable with any other aspect includes the following features. An outer diameter of the annular portion is greater than an outer diameter defined by the multiple fingers.

An aspect combinable with any other aspect includes the following features. The second connector includes an annular portion having an inner diameter sized to receive the annular portion of the first connector and an axial portion having a length defining an inner diameter sized to receive the multiple fingers of the first connector.

An aspect combinable with any other aspect includes the following features. The axial portion of the second connector defines two shoulders on an inner surface of the axial portion. The two shoulders of the second connector are spaced apart to define spaces to receive the two shoulders of the first connector when the first connector is coupled to the second connector by the axial force toward each other.

An aspect combinable with any other aspect includes the following features. The multiple fingers can flex radially inward within the axial portion when the first connector is coupled to the second connector by the axial force toward each other.

An aspect combinable with any other aspect includes the following features. The third connector includes an annular portion at a first end of the third connector, and multiple fingers. A first end of each finger is attached to the annular portion. Each finger extends away from the first end and terminates at a second end.

An aspect combinable with any other aspect includes the following features. The multiple fingers can flex towards each other at respective second ends of the multiple fingers.

An aspect combinable with any other aspect includes the following features. Each finger defines an outer surface. Each outer surface of each finger defines one shoulder that extends radially away from the outer surface.

An aspect combinable with any other aspect includes the following features. An outer diameter of the annular portion is greater than an outer diameter defined by the multiple fingers.

An aspect combinable with any other aspect includes the following features. The fourth connector includes an annular portion and an axial portion. The annular portion has an inner diameter sized to receive the annular portion of the third connector. The axial portion has a length and defines an inner diameter sized to receive the multiple fingers of the third connector.

An aspect combinable with any other aspect includes the following features. The axial portion of the second connector defines one shoulder on an inner surface of the axial portion. The shoulder of the fourth connector is positioned on the axial portion to allow the shoulder of the third connector to pass when the third connector is coupled to the fourth connector by the axial force toward each other.

An aspect combinable with any other aspect includes the following features. The multiple fingers are configured to flex radially inward within the axial portion when the third connector is coupled to the fourth connector by the axial force toward each other.

Certain aspects of the subject matter described here can be implemented as a method. A wellbore is formed from a surface of the Earth through a subterranean zone of a subsurface reservoir. A tubing is installed within the wellbore. A downhole pump is installed at a downhole end of the tubing. The downhole pump can raise hydrocarbons in the subsurface reservoir to the surface. A first connector of a first quick-coupling connector assembly is coupled to a downhole end of a COROD. An axial downward force is applied on the COROD to couple the first connector to the second connector. The COROD is operated to axially reciprocate about the longitudinal axis of the wellbore to raise the hydrocarbons to the surface.

An aspect combinable with any other aspect includes the following features. To install the downhole pump at the downhole end of the tubing, a third connector of a second quick-coupling connector assembly is coupled to a downhole end of the tubing. A fourth connector of the second quick-coupling connector assembly is coupled to the downhole end of the pump. An axial downward force is applied on the downhole pump to couple the third connector to the fourth connector. An axial force to de-couple the first connector from the second connector is greater than an axial force to de-couple the third connector from the fourth connector and less than a breaking force at which the COROD breaks.

Thus, particular implementations of the subject matter have been described. Other implementations are within the scope of the following claims.

The invention claimed is:

1. A well completion comprising:

a downhole pump configured to be disposed at a downhole location within a wellbore, the downhole pump configured to lift hydrocarbons from the downhole location to a surface of the wellbore;

a continuous sucker rod string (COROD) configured to couple to the downhole pump, the COROD configured to axially reciprocate about a longitudinal axis of the wellbore;

a first quick-coupling connector assembly comprising:

a first connector coupled to an end of the COROD configured to couple to the downhole pump;

a second connector coupled to an end of the downhole pump configured to couple to the COROD, the first connector and the second connector configured to be coupled by an axial force toward each other and to be de-coupled by an opposing axial force away from each other without using one-time shear pins;

a tubing configured to be disposed within the wellbore, wherein the downhole pump is configured to be installed within and at an end of the tubing; and a second quick-coupling connector assembly comprising:

a third connector installed at the end of the tubing at which the downhole pump is to be installed; and a fourth connector coupled to an end of the downhole pump configured to be installed at the end of the tubing, the third connector and the fourth connector configured to be coupled by an axial force toward each other and to be de-coupled by an opposing axial force away from each other, wherein the axial force to de-couple the first connector from the second connector is greater than the axial force to de-couple the third connector from the fourth connector.

2. The well completion of claim 1, wherein the axial force to de-couple the first connector from the second connector is less than a force at which the COROD breaks.

3. The well completion of claim 1, wherein the first connector comprises:

an annular portion at a first end of the first connector; and a plurality of fingers, a first end of each finger attached to the annular portion, each finger extending away from the first end and terminating at a second end.

4. The well completion of claim 3, wherein the plurality of fingers are configured to flex towards each other at respective second ends of the plurality of fingers.

5. The well completion of claim 4, wherein each finger defines an outer surface, wherein each outer surface of each finger defines two shoulders that are axially spaced apart and that extend radially away from the outer surface.

6. The well completion of claim 3, wherein an outer diameter of the annular portion is greater than an outer diameter defined by the plurality of fingers.

7. The well completion of claim 6, wherein the second connector comprises:

an annular portion having an inner diameter sized to receive the annular portion of the first connector; and an axial portion having a length and defining an inner diameter sized to receive the plurality of fingers of the first connector.

8. The well completion of claim 7, wherein the axial portion of the second connector defines two shoulders on an inner surface of the axial portion, the two shoulders of the second connector spaced apart to define spaces to receive the two shoulders of the first connector when the first connector is coupled to the second connector by the axial force toward each other.

9. The well completion of claim 8, wherein the plurality of fingers are configured to flex radially inward within the axial portion when the first connector is coupled to the second connector by the axial force toward each other.

10. The well completion of claim 1, wherein the third connector comprises:

an annular portion at a first end of the third connector; and a plurality of fingers, a first end of each finger attached to the annular portion, each finger extending away from the first end and terminating at a second end.

11. The well completion of claim 10, wherein the plurality of fingers are configured to flex towards each other at respective second ends of the plurality of fingers.

12. The well completion of claim 11, wherein each finger defines an outer surface, wherein each outer surface of each finger defines one shoulder that extends radially away from the outer surface.

13. The well completion of claim 12, wherein an outer diameter of the annular portion is greater than an outer diameter defined by the plurality of fingers.

14. The well completion of claim 13, wherein the fourth connector comprises:

an annular portion having an inner diameter sized to receive the annular portion of the third connector; and an axial portion having a length and defining an inner diameter sized to receive the plurality of fingers of the third connector.

15. The well completion of claim 14, wherein the axial portion of the second connector defines one shoulder on an inner surface of the axial portion, the shoulder of the fourth connector positioned on the axial portion to allow the shoulder of the third connector to pass when the third connector is coupled to the fourth connector by the axial force toward each other.

16. The well completion of claim 15, wherein the plurality of fingers are configured to flex radially inward within the axial portion when the third connector is coupled to the fourth connector by the axial force toward each other.

17. A method comprising:

forming a wellbore from a surface of the Earth through a subterranean zone to a subsurface reservoir;

installing a tubing within the wellbore;

installing a downhole pump at a downhole end of the tubing, the downhole pump configured to raise hydrocarbons in the subsurface reservoir to the surface;

coupling a first connector of a first quick-coupling connector assembly to an uphole end of the downhole pump;

coupling a second connector of the first quick-coupling connector assembly to a downhole end of a continuous sucker rod string (COROD);

applying an axial downward force on the COROD to couple the first connector to the second connector without using one-time shear pins; and operating the COROD to axially reciprocate about the longitudinal axis of the wellbore to raise the hydrocarbons to the surface, wherein installing the downhole pump at the downhole end of the tubing comprises:

coupling a third connector of a second quick-coupling connector assembly to the downhole end of the tubing;

coupling a fourth connector of the second quick-coupling connector assembly to the downhole end of the pump; and applying an axial downward force on the downhole pump to couple the third connector to the fourth connector, wherein an axial force to de-couple the first connector from the second connector is greater than an axial force to de-couple the third connector from the fourth connector and less than a breaking force at which the COROD breaks.

* * * * *